US005984099A

United States Patent [19]

Shimizu et al.

[11] Patent Number: 5,984,099

[45] Date of Patent: Nov. 16, 1999

[54] CONTAINER FOR DISPLAY AND STORAGE

[75] Inventors: Keizi Shimizu; Kuninori Ide; Yoshio Nagahama; Takashi Nogi; Chiaki Hata, all of Osaka; Naomi Okamura, Tokyo; Akio Nimura, Tokyo; Takao Hino, Tokyo; Masayuki Fukai, Tokyo, all of Japan

[73] Assignees: Taoka Chemical Co., Ltd., Osaka; Cemedine Co., Ltd., Tokyo, both of Japan

[21] Appl. No.: 09/065,486

[22] Filed: Apr. 24, 1998

Related U.S. Application Data

[63] Continuation of application No. PCT/JP96/03106, Oct. 23, 1996.

[30] Foreign Application Priority Data

Oct. 26, 1995 [JP] Japan ..... 7-303823
Feb. 16, 1996 [JP] Japan ..... 8-53981

[51] Int. Cl.[6] ..... B65D 73/00

[52] U.S. Cl. ..... 206/462; 206/469; 206/471

[58] Field of Search ..... 206/461, 462, 206/469, 470, 471

[56] References Cited

U.S. PATENT DOCUMENTS

| | | | |
|---|---|---|---|
| 3,018,879 | 1/1962 | Crane, Jr. | 206/461 |
| 3,298,515 | 1/1967 | Watts, Jr. | 206/469 |
| 3,303,930 | 2/1967 | Hyland | 206/471 |
| 3,407,928 | 10/1968 | Watts, Jr. | 206/470 |
| 3,559,779 | 2/1971 | Kramer et al. | 206/469 |
| 4,200,193 | 4/1980 | Boyle | 206/461 |
| 4,353,461 | 10/1982 | Liang | 206/469 |
| 4,923,063 | 5/1990 | Tararuj | 206/469 |
| 4,951,404 | 8/1990 | Lithwick | 206/461 |
| 5,443,154 | 8/1995 | Hustad et al. | 206/469 |

FOREIGN PATENT DOCUMENTS

H1179871 12/1989 Japan .

*Primary Examiner*—Paul T. Sewell
*Assistant Examiner*—J. Mohandesi
*Attorney, Agent, or Firm*—Birch, Stewart, Kolasch & Birch, LLP

[57] ABSTRACT

There is provided a container for display and storage comprising a body rectangular base sheet and a lid rectangular base sheet connected in a double spread sheet (or folded) condition by a folding line along the longitudinal direction. The rectangular base sheet on the body side is provided with a transparent cover in which an article can be contained and an opening is provided in the reverse face through which the article can be freely taken out and put in.

25 Claims, 20 Drawing Sheets

【Fig. 1】
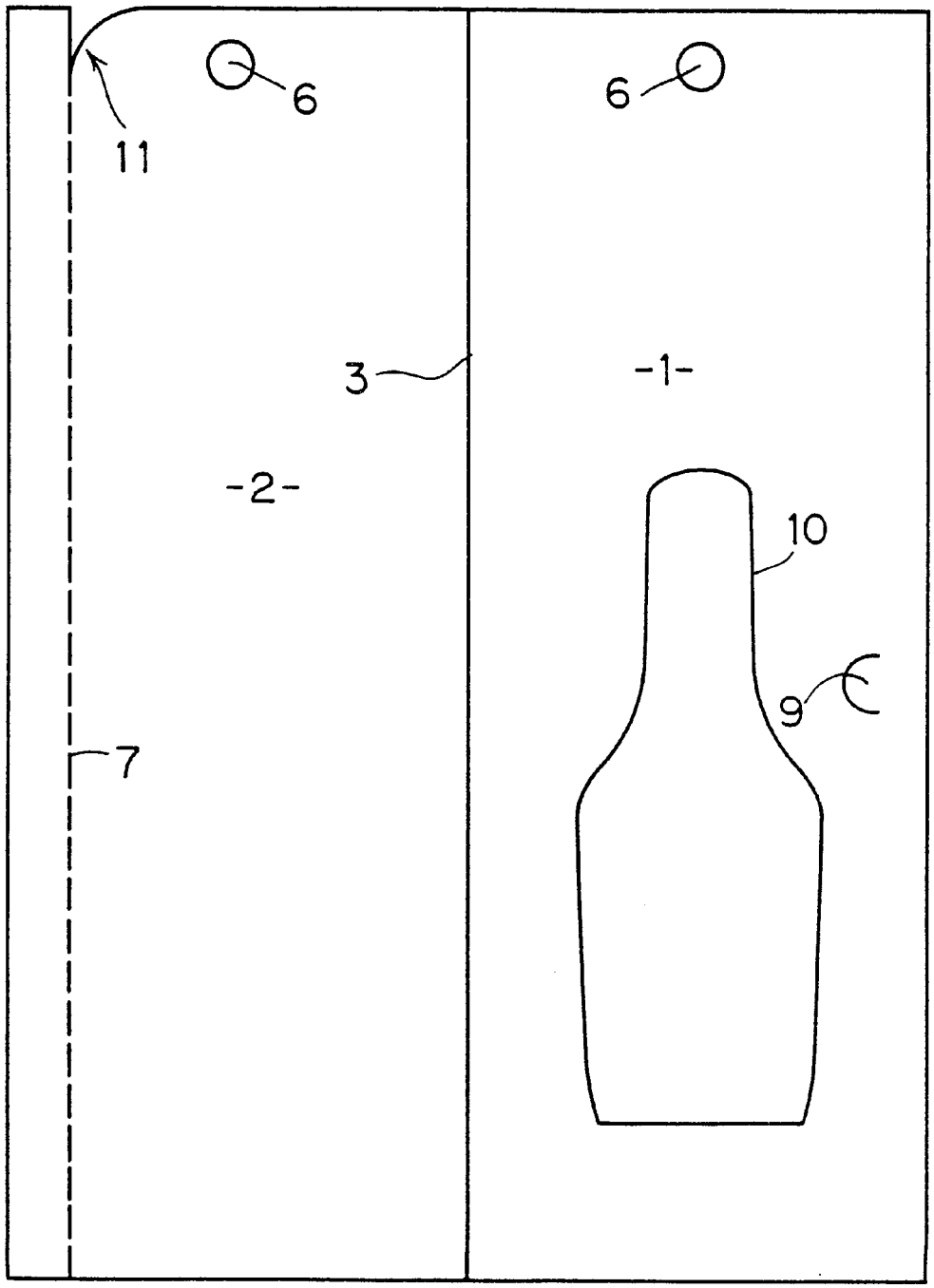

【Fig. 2】
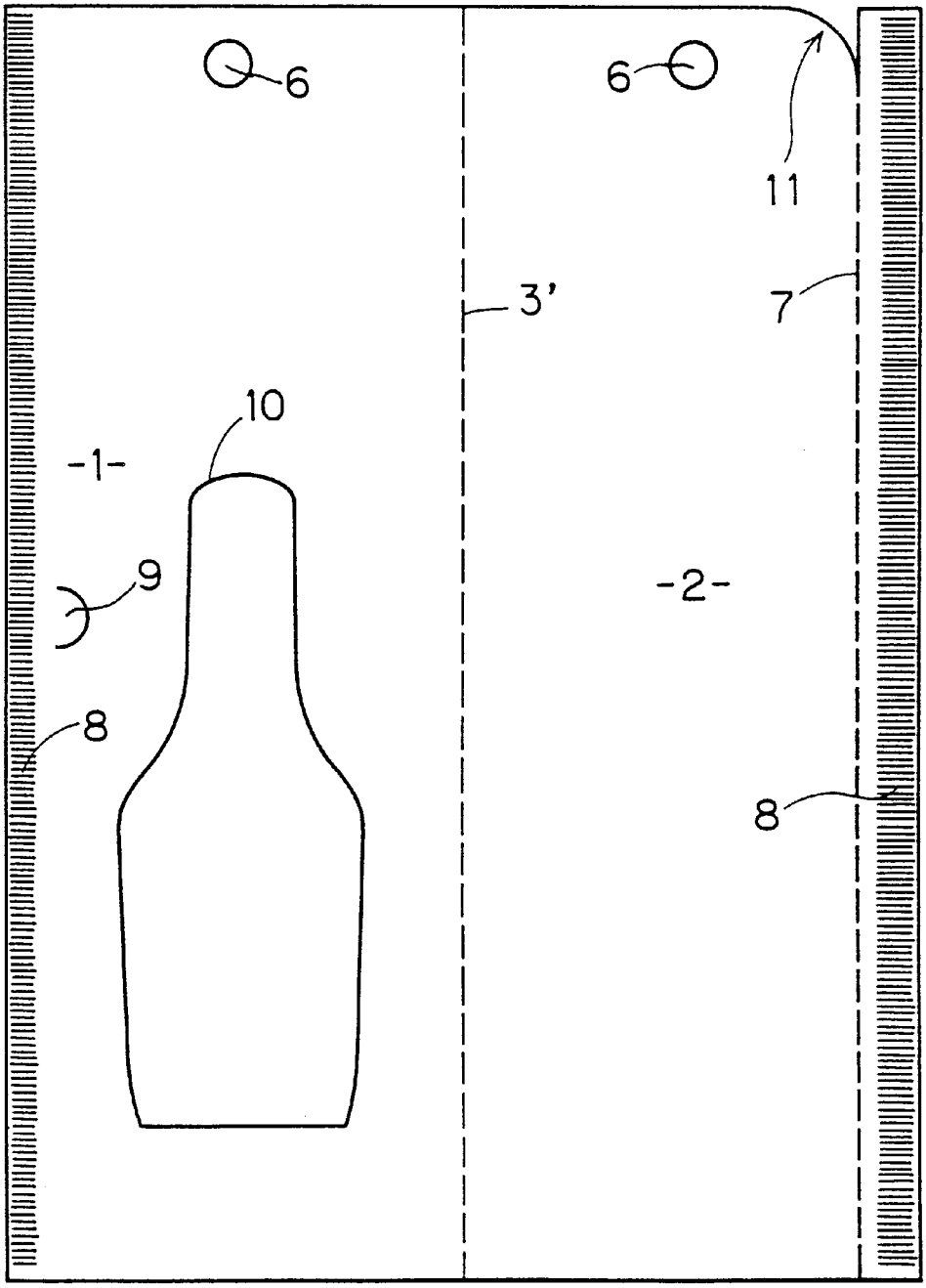

【Fig.3】
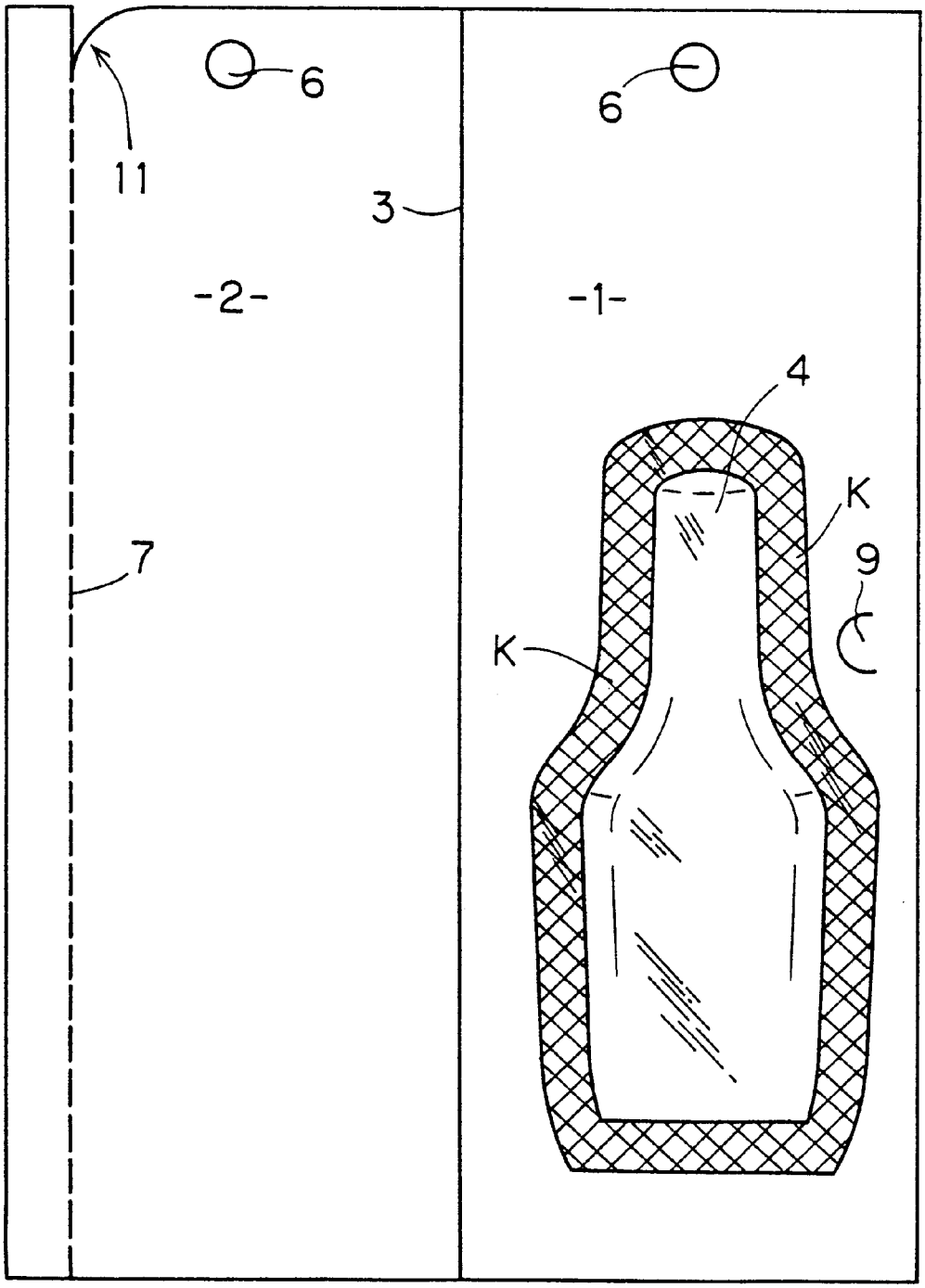

【Fig. 4】
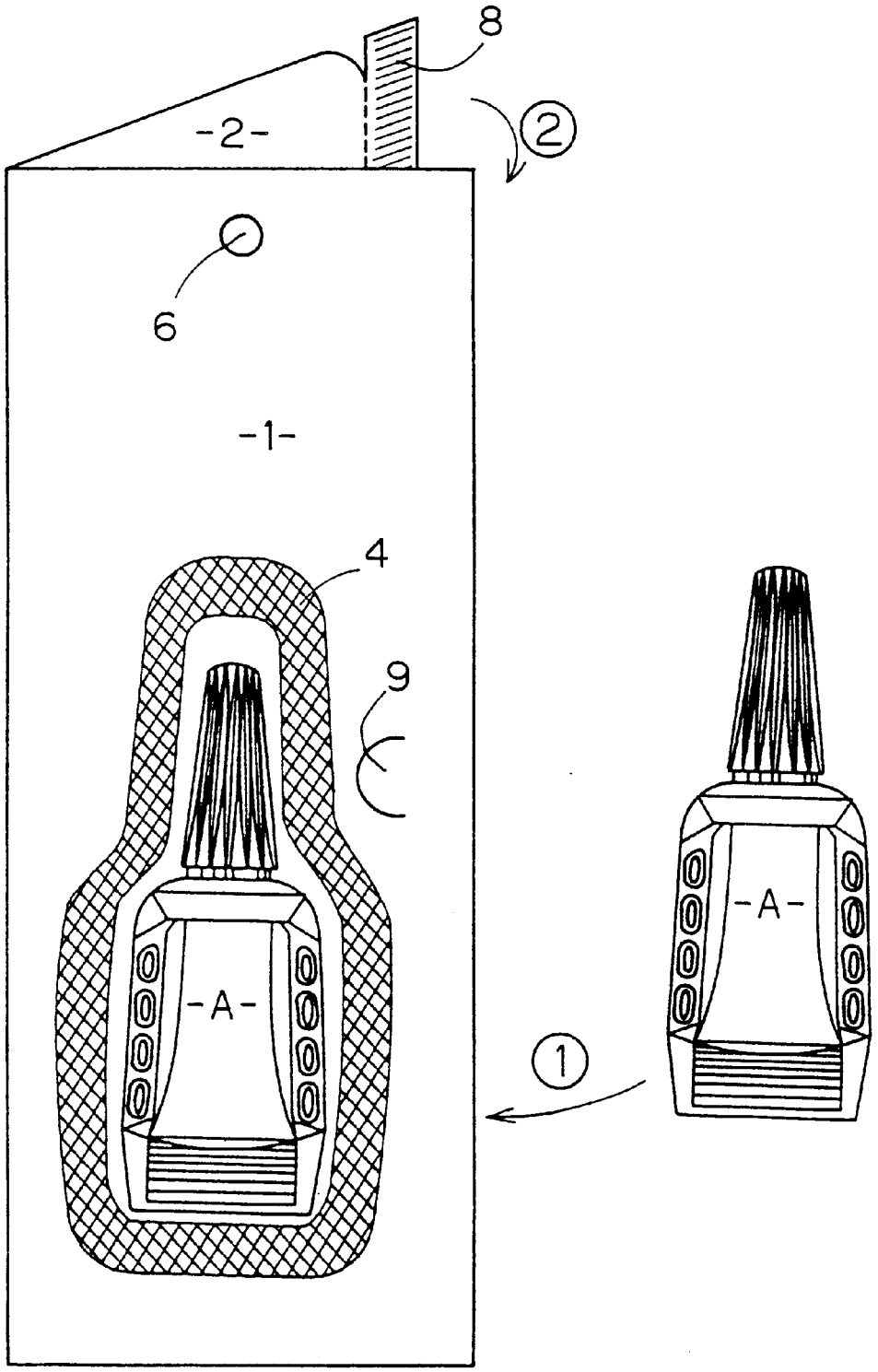

【Fig. 5】
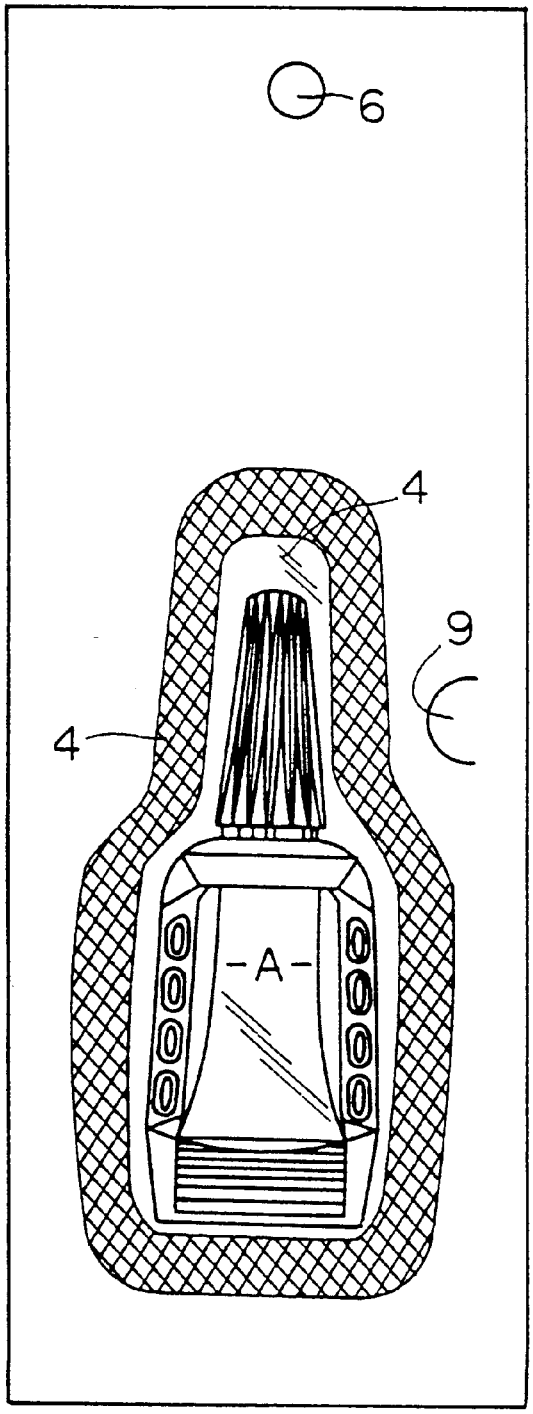

【Fig.6】
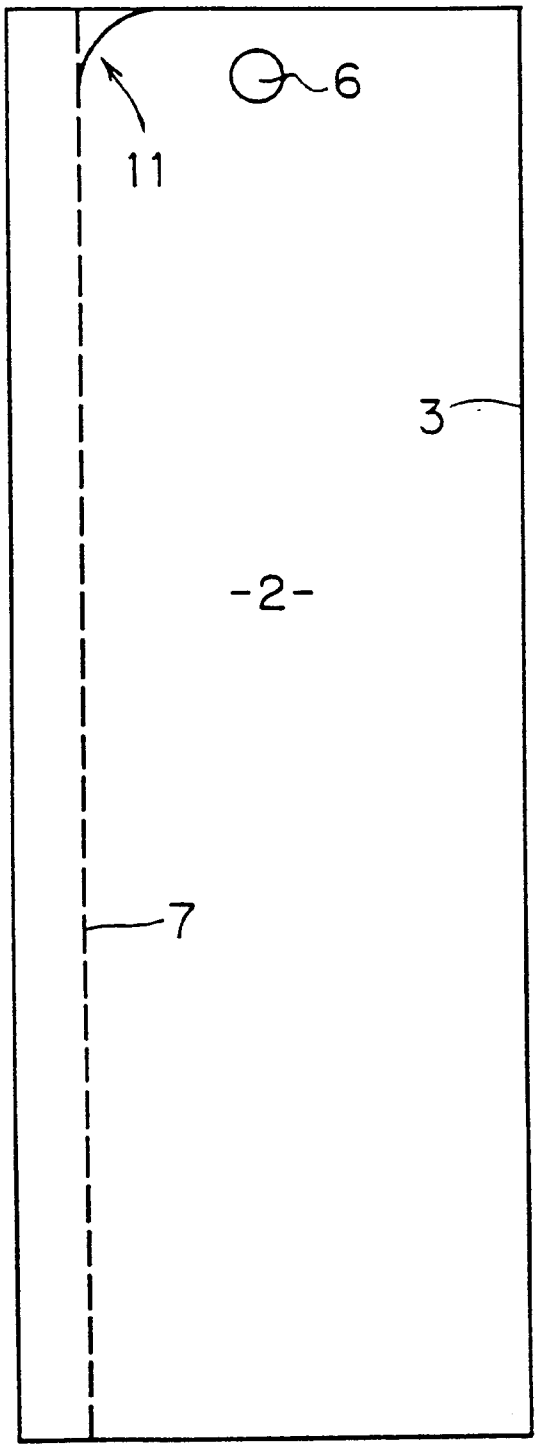

【Fig. 7 】
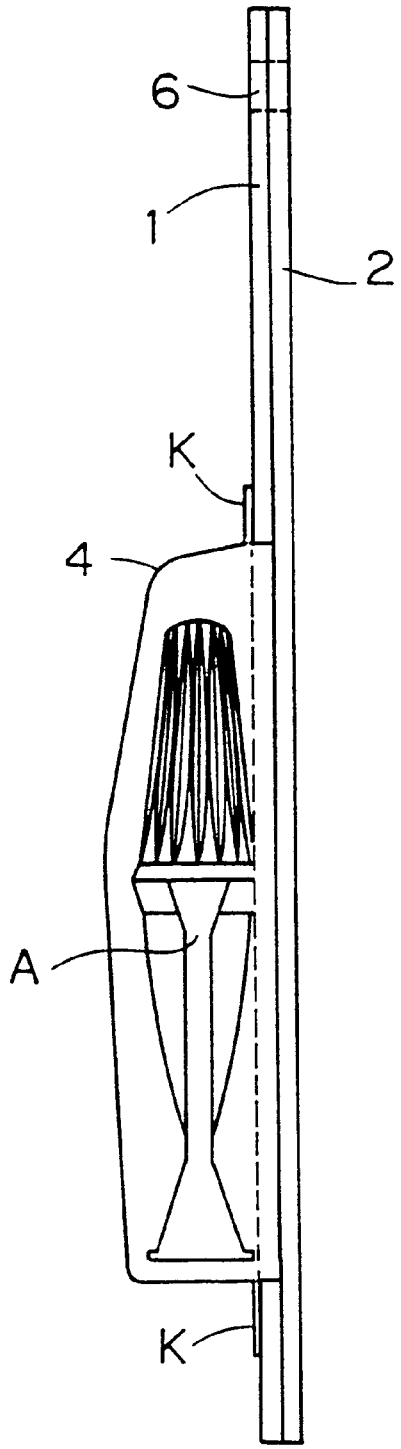

【Fig. 8】
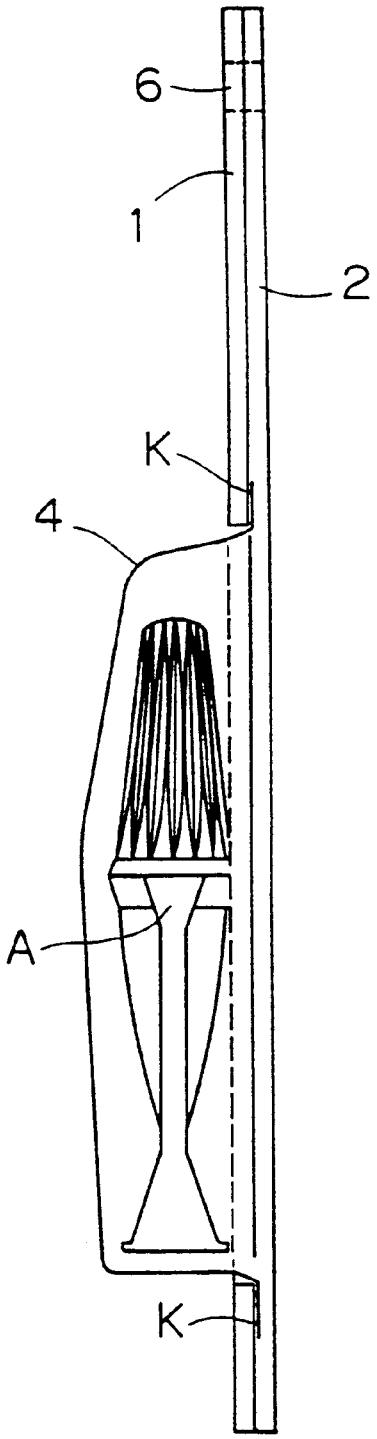

【Fig. 9】
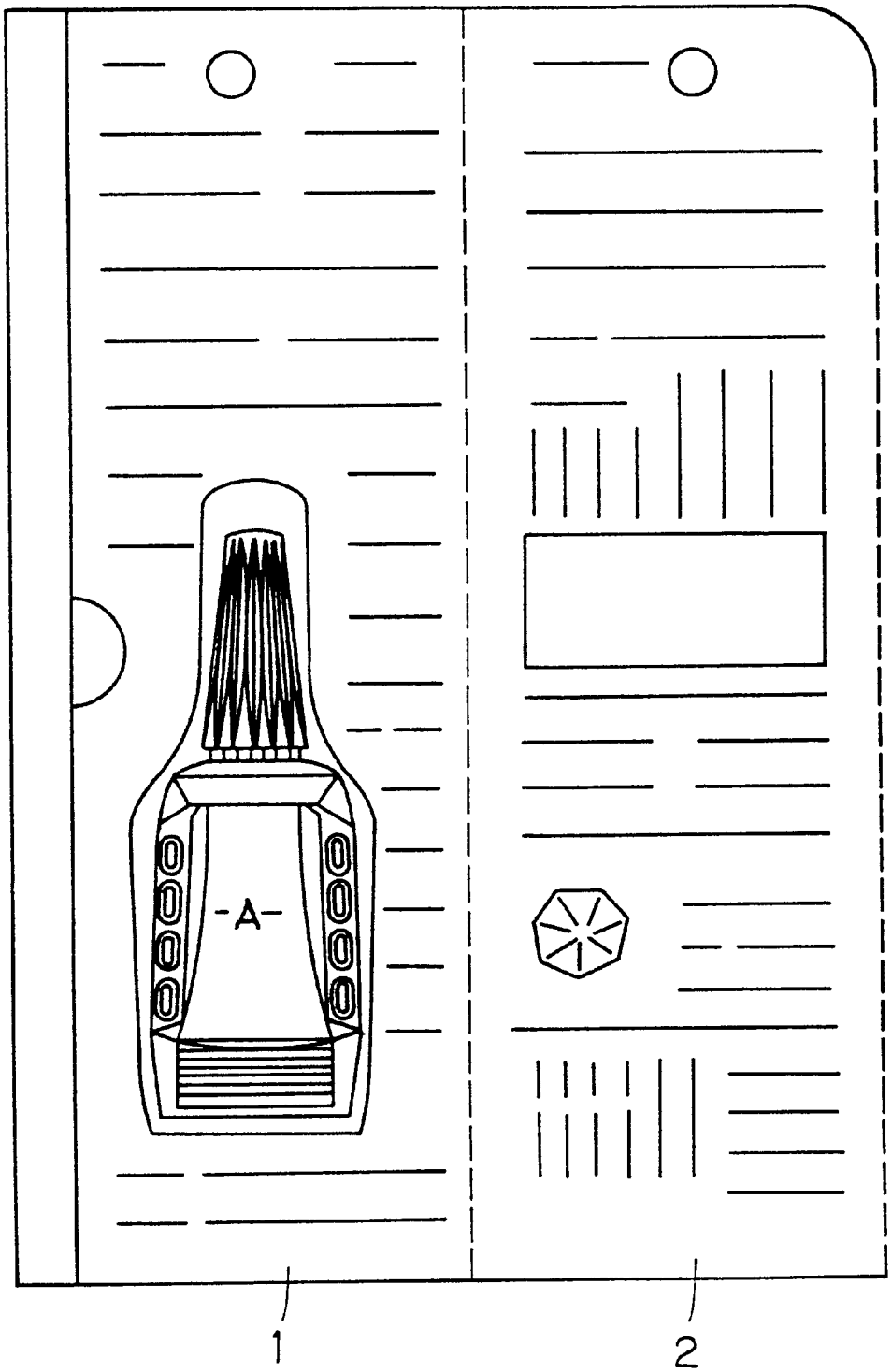

【Fig. 10】
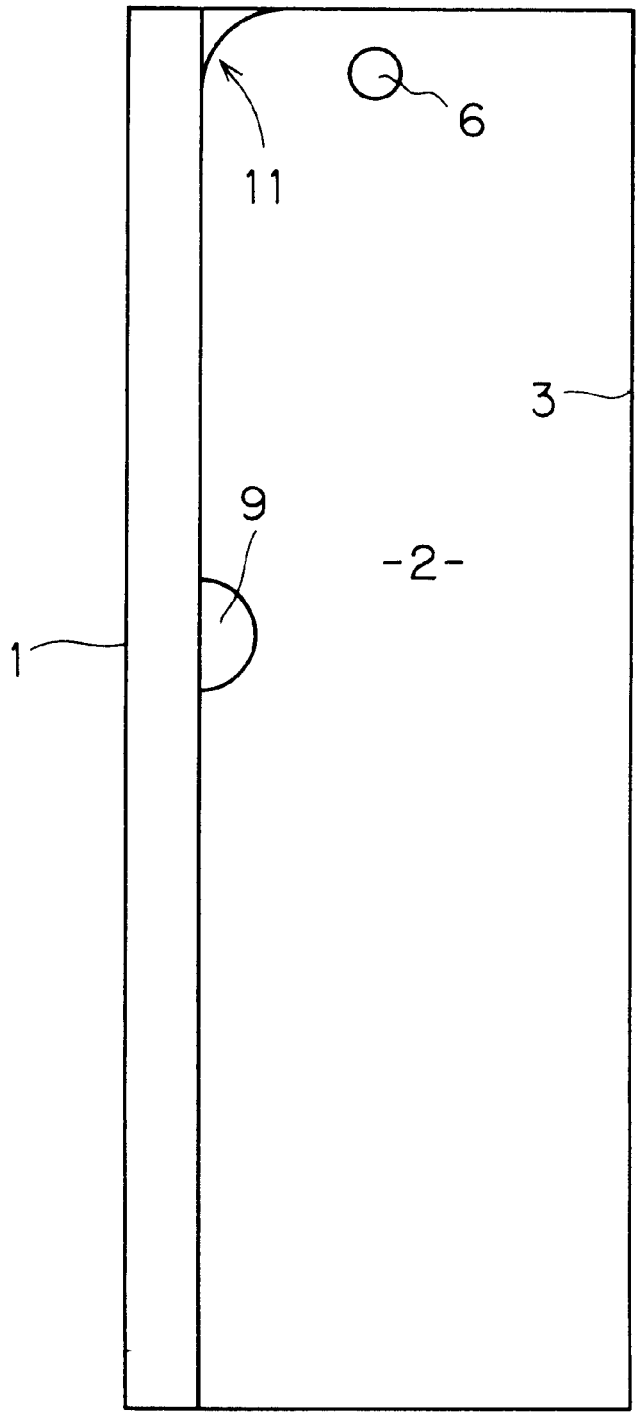

【Fig. 11】
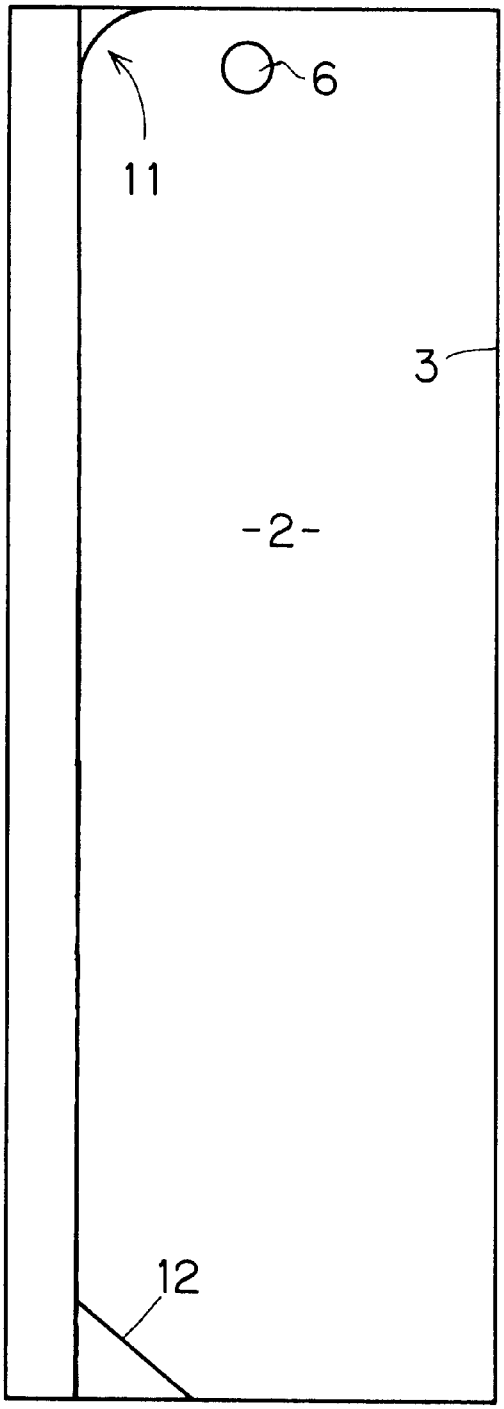

【Fig. 12】
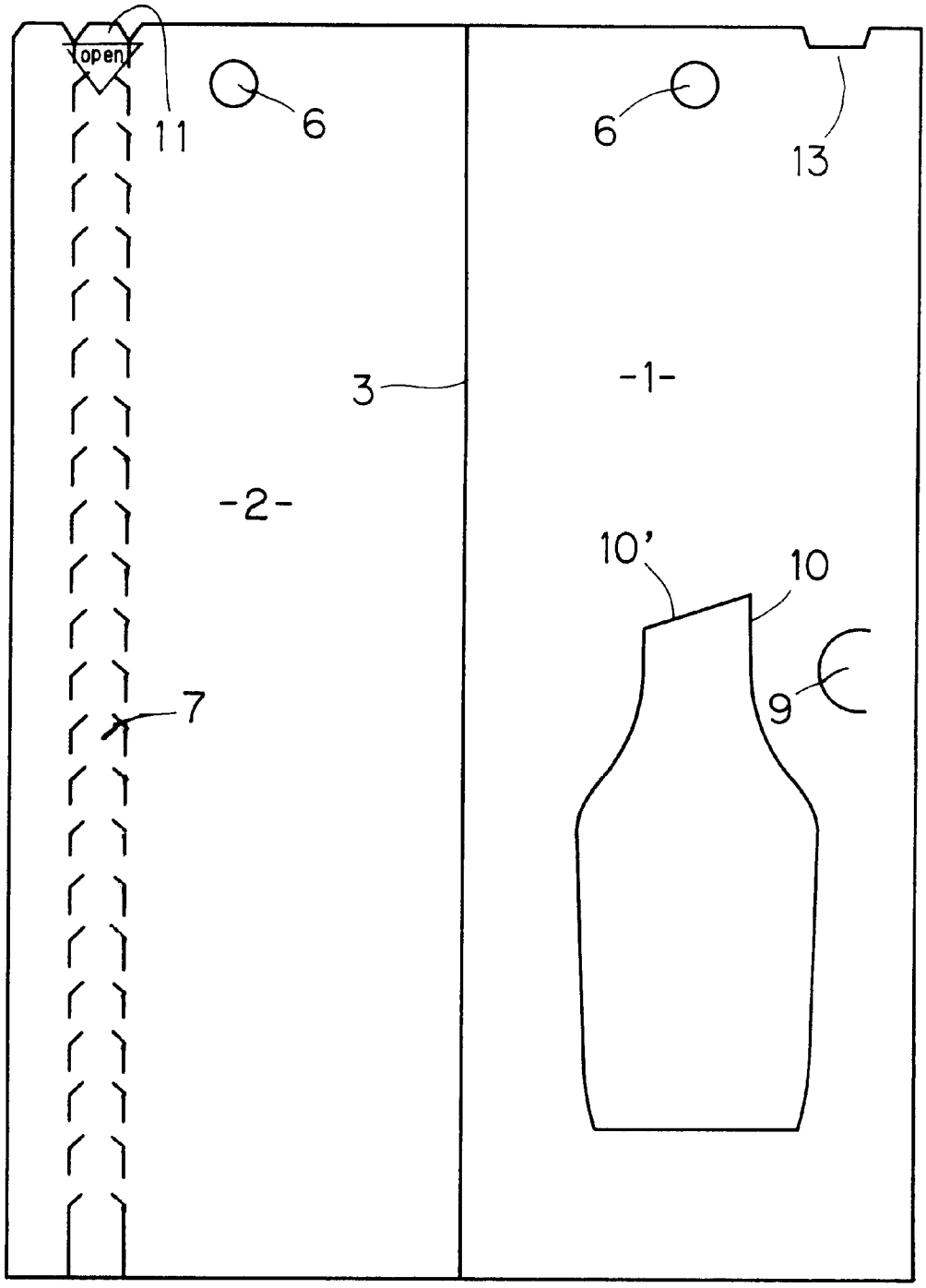

【Fig. 13】
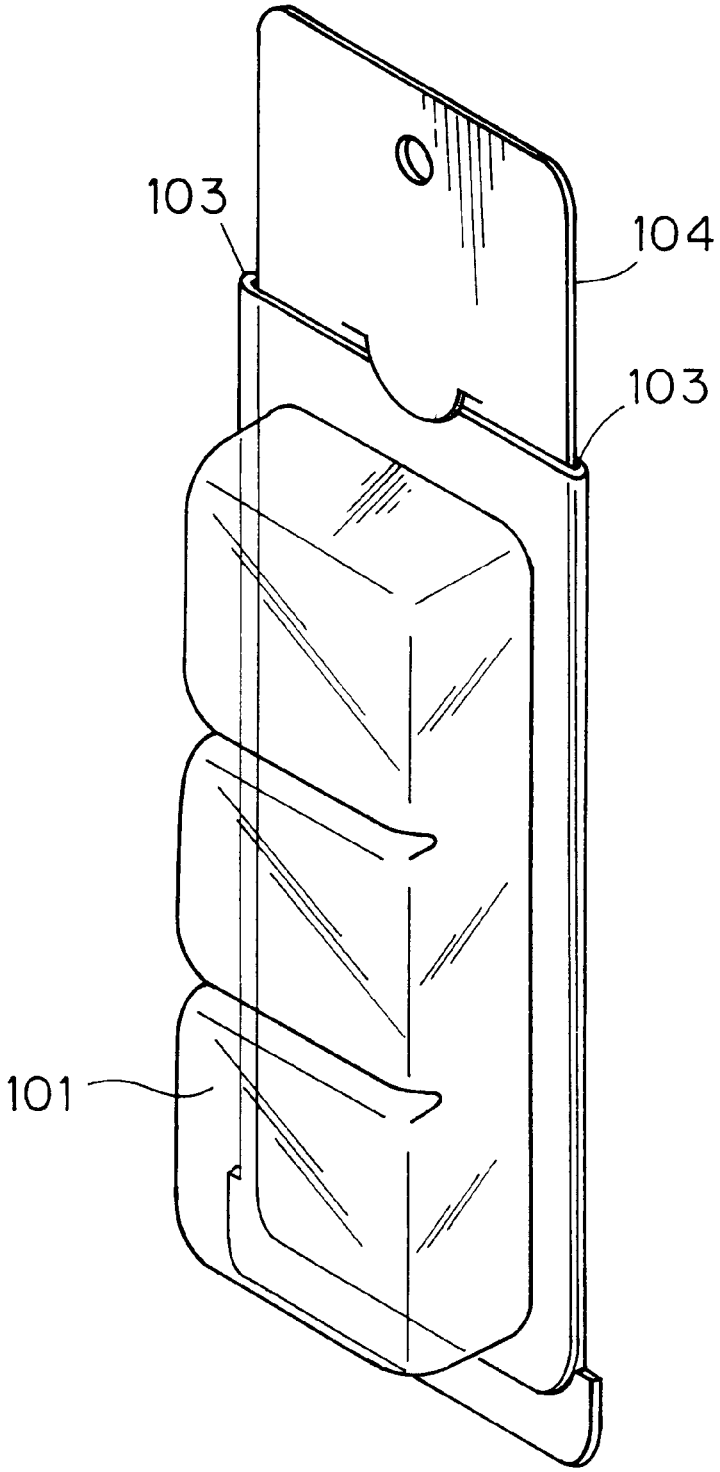

【Fig. 14 】
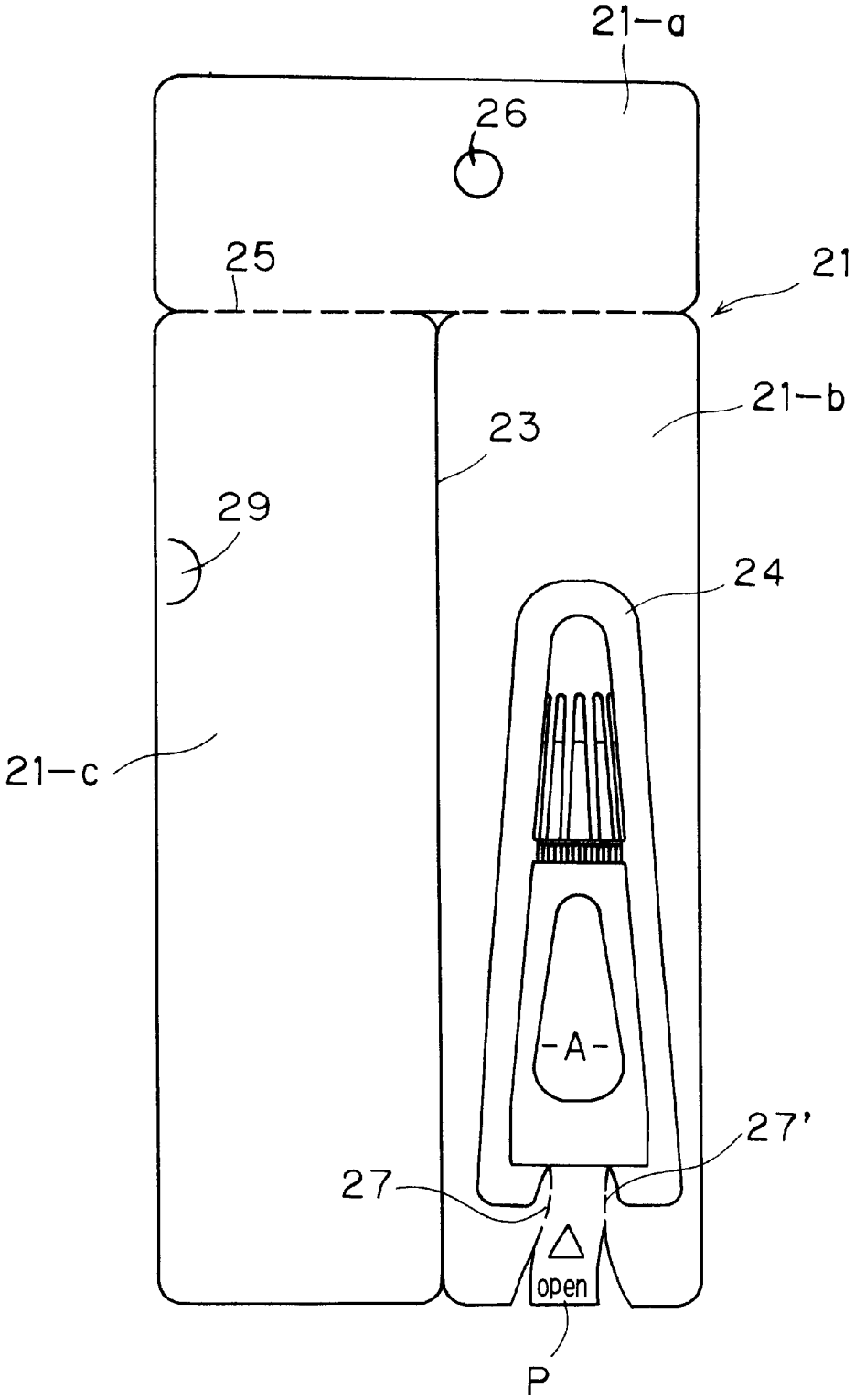

【Fig. 15】
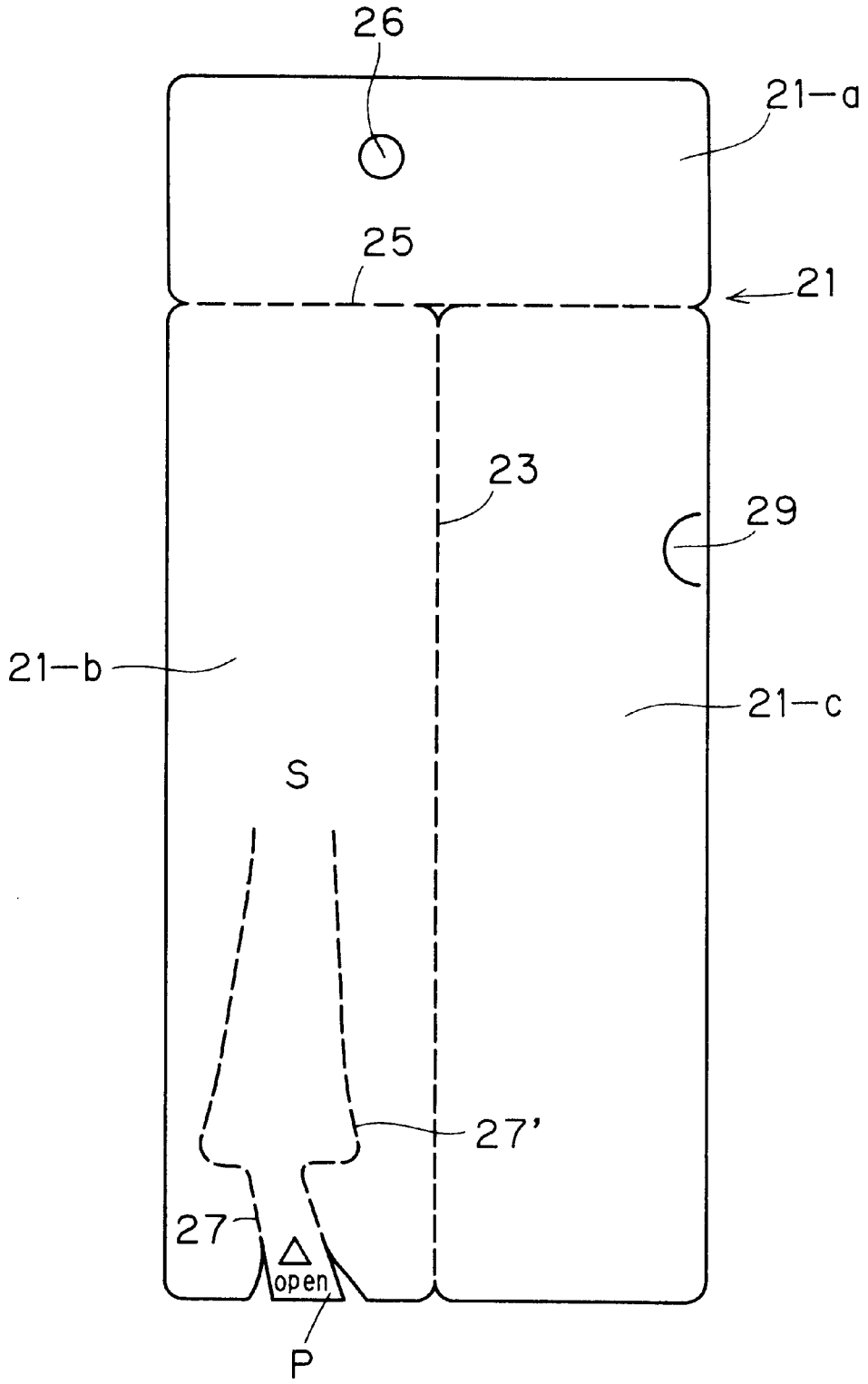

【Fig.16】
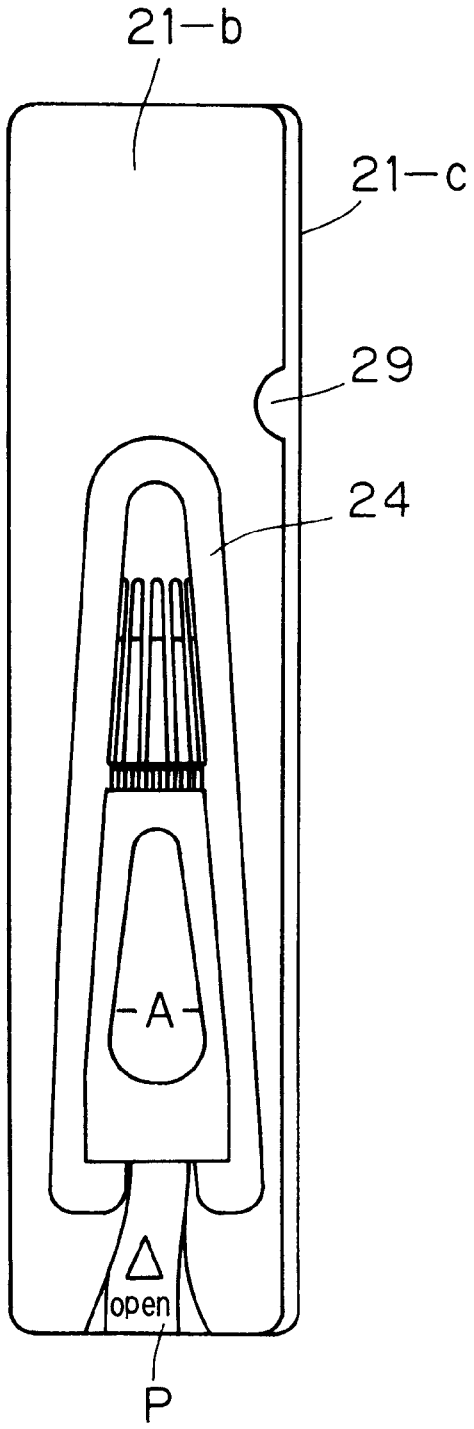

【Fig. 17】
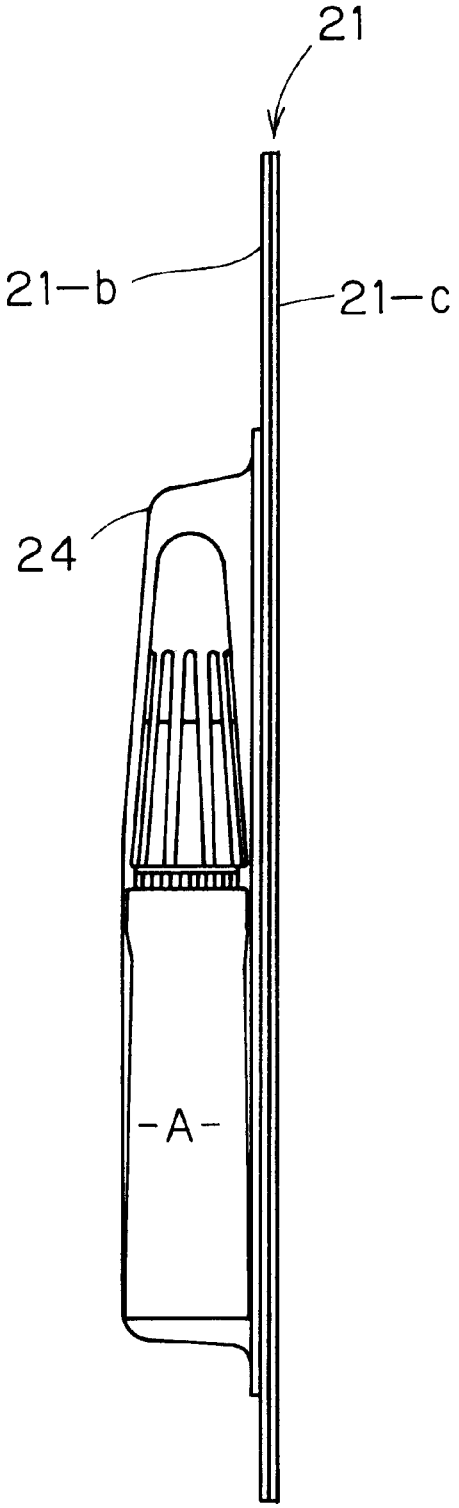

【Fig.18】
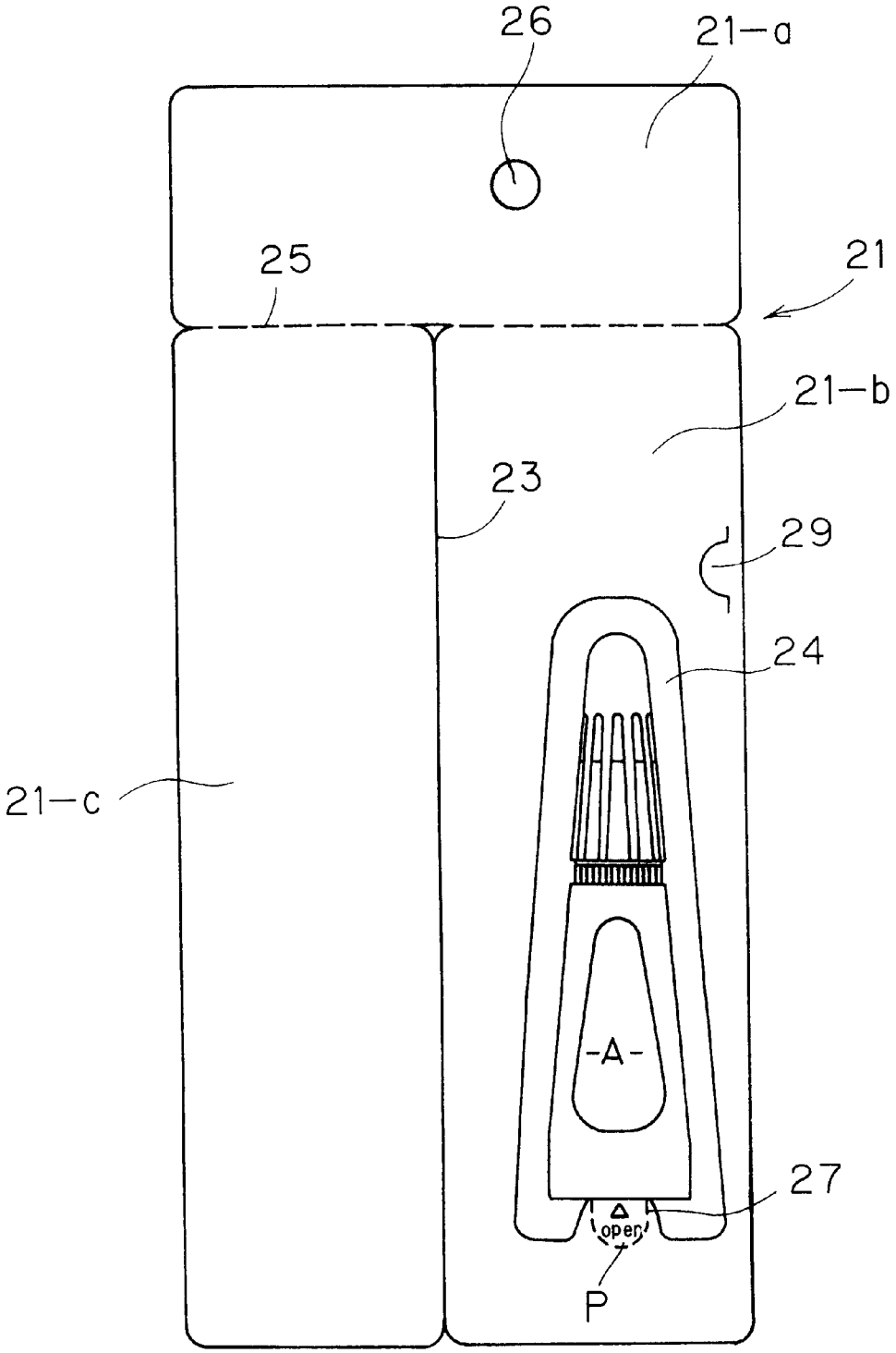

【Fig. 19】
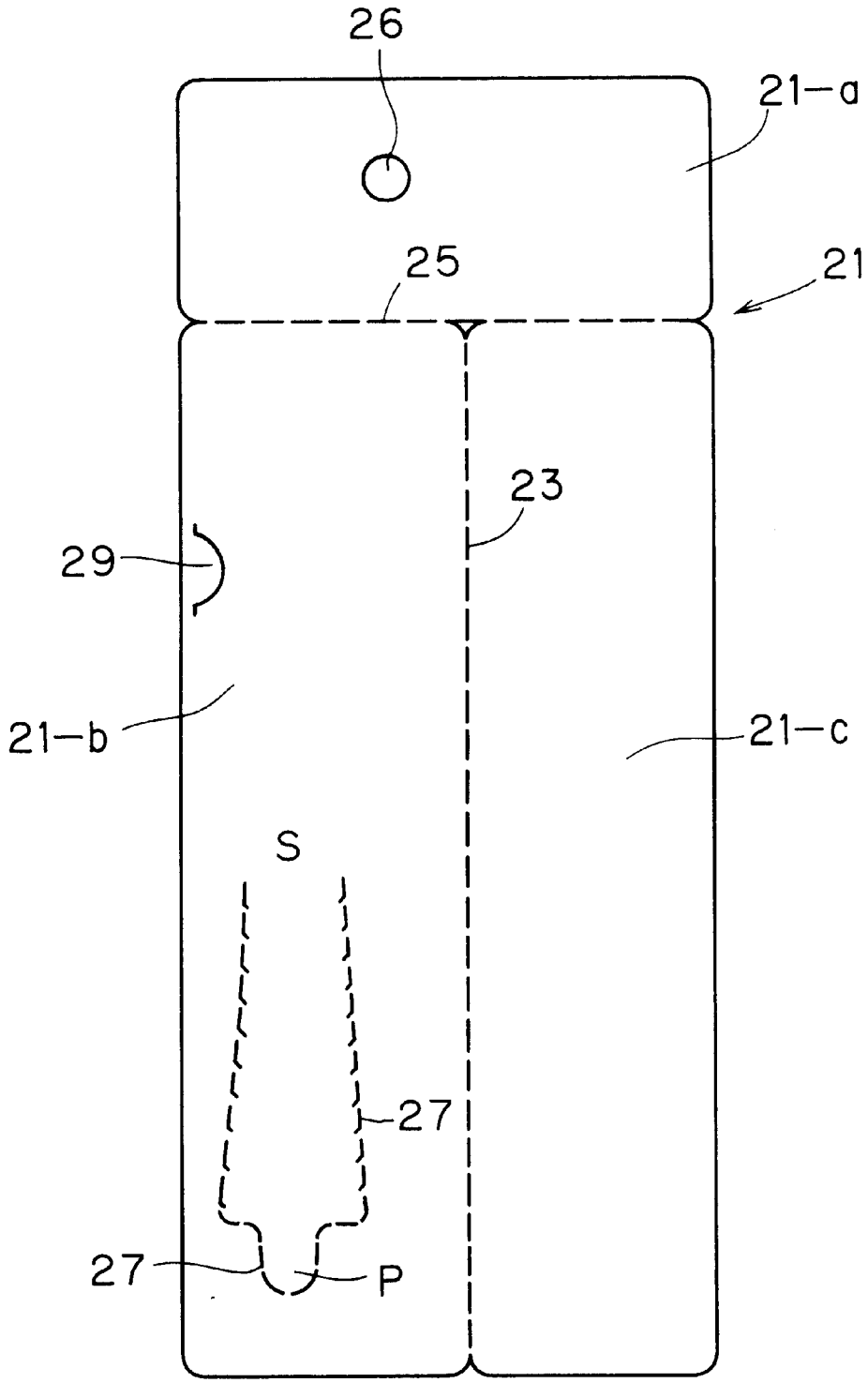

【Fig.20】
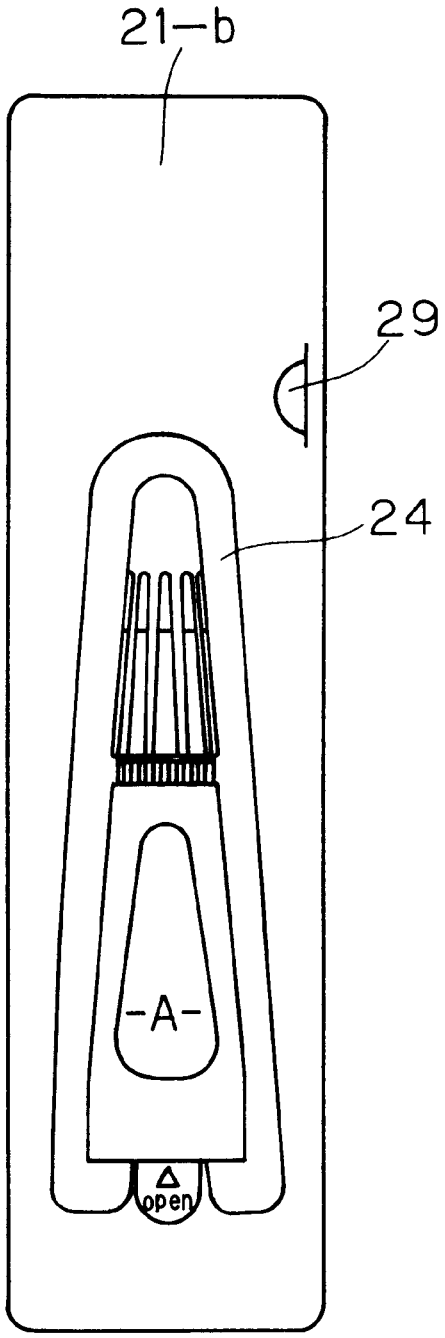

CONTAINER FOR DISPLAY AND STORAGE

This application is a PCT continuation of PCT application Ser. No. PCT/JP96/03106 filed on Oct. 23, 1996, which designated the United States and on which priority is claimed under 35 U.S.C. § 120.

FIELD OF THE INVENTION

The present invention relates to an improvement of a container for display and storage of articles such as for example instantaneous adhesives (a so-called blister pack).

BACKGROUND OF THE INVENTION

In marketing the chemical products such as pharmaceuticals, cosmetics, especially instantaneous adhesives, the articles are contained in the transparent resin cover on a base sheet of cardboard, aluminum container, or laminate film, etc. and displayed, exhibited, etc. as a so-called blister pack for sale. The base sheets are provided with instructions on use of the product (hereinafter to be referred to as an article) and special remarks, etc.

To remove the article from the blister pack, the blister pack is broken, and it is usual to throw the used pack into the trash. As a result, there arises an article with no instructions on hand when using the article at a later time, etc.

As a method for solving the above problem, there is disclosed in FIG. 13, for example, in Japanese Patent Laid-Open Publication No. H1-179871, a display container which is a slide pack comprising a transparent resin cover 101 having grooves 103 so as to accommodate both sides of a base sheet 104 therein. Such a container may again contain the article after use, and the problem as described above is dissolved.

According to the recent system of selling at a counter, due to the necessity to make display, exhibition, etc. of many articles in a predetermined space, the size of the base sheet is limited. Consequently, the space for listing the instructions and special remarks is also a problem. Such a problem cannot be solved by the prior art as described above.

The present invention is designed to provide a slim container for display and storage in which the prior art problems have been resolved by an extremely simple and rational method, that is industrially advantageous.

SUMMARY OF THE INVENTION

The present invention includes a container for display and storage comprising a rectangular base sheet body and a rectangular base sheet lid connected in a double spread sheet (or folded) condition having a folding line along the longitudinal direction, with the rectangular base sheet on a body side being provided with a transparent cover in which an article can be contained. The invention includes an opening in the reverse face through which the article can be freely taken out and put in.

In the first embodiment of the present invention, a container for display and storage includes a rectangular base sheet body and a rectangular base sheet lid which are connected. The body and lid are connected by a double spread sheet (or folded ends). The connection includes ends connected in a Chinese style binding. On the rectangular base sheet body an open port is provided through which articles can be freely taken out and put in. The rectangular base sheet body further includes a temporary stopping mechanism for stopping the rectangular base sheet body and the rectangular base sheet lid, and a transparent cover for accommodating the article. The rectangular base sheet lid is provided at its end part with an opening mechanism.

In a second embodiment of the present invention, a container for display and storage includes in the vicinity of the center line in the longitudinal direction of the rectangular base sheet body (the sheet body being made by attaching a transparent cover that can contain articles along the said center line), a folding line. On the rectangular base sheet body, a nick line is engraved so as to allow the articles to be freely taken out and put in from the reverse side. A rectangular base sheet lid is provided to act as a lid for the port to take out the article by the folding of the body rectangular base sheet.

One inventive feature of the present invention is that the rectangular base sheet body and the rectangular base sheet lid are connected in a folded condition or double spread sheet condition by a folding line disposed along the longitudinal direction. A transparent cover is provided on the rectangular base sheet body in which the article can be stored. An open port through the reverse side of the transparent cover permits articles to be freely taken out and put in. Thus, by temporarily stopping the rectangular base sheet lid connected in a double spread sheet (or folded) condition, a container for storing the article is made.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a surface view of the rectangular base sheet body and the rectangular base sheet lid of the container for display and storage.

FIG. 2 is a reverse side view of FIG. 1.

FIG. 3 is an illustration of the surface view of FIG. 1 provided with a transparent cover.

FIG. 4 is an illustrative view showing the condition where an article 5 is contained in the transparent cover 4 of FIG. 2 and the rectangular base sheet lid 2 which includes a spread sheet style is closed.

FIG. 5 is a surface view of the completed container for display and storage of the present invention.

FIG. 6 is a reverse side view of the complete container for display and storage of the present invention.

FIG. 7 is a brief side view of the container for display and storage of the present invention.

FIG. 8 is another brief side view of the container for display and storage of the present invention.

FIG. 9 is a reverse side view of the container for display and storage of the present invention made in a condition of double spread sheet.

FIG. 10 is a reverse side view of the container for display and storage of the present invention which is in a temporarily stopped condition after use.

FIG. 11 is another reverse side view of the container for display and storage of the present invention which is in a temporarily stopped condition after use.

FIG. 12 is a surface view for illustrating the deformation in the scope of the present invention.

FIG. 13 is a perspective view of an example of the conventional container for display and storage.

FIG. 14 is a surface view shoring another container for display and storage of the present invention.

FIG. 15 is a reverse side view of FIG. 14.

FIG. 16 is a surface view showing a container for display and storage of the present invention.

FIG. 17 is a right side view of FIG. 16.

FIG. 18 is a surface view showing another example of a container for display and storage of the present invention.

FIG. 19 is a reverse side view of FIG. 18.

FIG. 20 is a surface view showing a container for display and storage of the present invention.

BEST MODE FOR PRACTICING THE INVENTION

Hereinafter, the present invention is described in more detail with reference to the drawings.

According to the preferred embodiment of the present invention, as shown in FIG. 1 to FIG. 13, the container for display and storage is characterized in that the rectangular base sheet body 1 and the rectangular base sheet lid 2 are connected along the folded line, by a double spread sheet with a thin wall groove along the longitudinal direction while the other end is connected in a Chinese binding style. On the rectangular base sheet body 1 an open port 10 is provided through which an article A can be freely taken out and put in. Also provided on the rectangular base sheet body are a temporary stopping mechanism 9 for stopping the rectangular base sheet body 1 and the rectangular base sheet lid 2, and a transparent cover 4 for accommodating the article A. The rectangular base sheet lid 2 is provided at its end part with a cut opening mechanism 7.

The reference numerals in the drawing are as follows:

1 . . . Rectangular base sheet body
2 . . . Rectangular base sheet lid
3 . . . Thin wall groove (half cut)
4 . . . Transparent cover
6 . . . Hole for hanging
7 . . . Cut opening mechanism (example of line form nick)
8 . . . (Horizontal line shaded part) Part to be bonded
9 . . . Projection for temporary stopping
10 . . . Open port
11 . . . Cut open part
12 . . . Nick for temporary stopping
13 . . . Recess for cutting
A . . . Article
K . . . Adhesive part between transparent cover and body rectangular base sheet FIG. 1 is the surface view of the rectangular base sheet body and the rectangular base sheet lid 2 of the container for display and storage showing a double spread sheet while FIG. 2 is a reverse side view thereof.

FIG. 3 is a surface view of FIG. 1 provided with a transparent cover 4 attached by adhesion. The portion of adhesive combination of the transparent cover 4 is shown by K.

FIG. 4 is an illustrative view showing the condition where an article A is contained in the transparent cover 4 of FIG. 2 and the rectangular base sheet lid 2 is closed upon the rectangular base sheet body. The rectangular base sheet body 1 and the rectangular base sheet lid 2 are connected in a Chinese binding style with the adhesive part 8 of the rectangular base sheet lid 2.

FIG. 5 is a surface view of the completed container for display and storage of the present invention which is bound by Chinese adhesion style.

FIG. 6 is a reverse side view of the complete container for display and storage of the present invention.

FIG. 7 is a brief side view of the container for display and storage of the present invention.

FIG. 8 is another brief side view of the container for display and storage of the present invention.

FIG. 9 is a reverse side view of the completed container for display and storage of the present invention made by a double spread sheet.

FIG. 10 is a reverse side view of the container for display and storage of the present invention which is in a condition of temporary stopping with the temporary stopping projection 9 after use.

FIG. 11 is another reverse side view of the container for display and storage of the present invention which is in a condition temporarily stopped with the temporary stopping cutting 12 after use.

FIG. 12 is a surface view for illustrating the deformation in the scope of the present invention.

FIG. 13 is a perspective view showing an example of the conventional container for display and storage.

Next, details of the container for display and storage of the present invention will be further explained.

The container for display and storage of the present invention which is a completed product as exemplified in FIG. 5 is a slim rectangle having a dimension of 17.5 cm in length X 6.3 cm in width. At the counter of the store, the container is displayed by hanging it by a hole 6.

One inventive feature of the present invention is that the container for display and storage has the rectangular base sheet body 1 and the rectangular base sheet lid 2 connected together by a folded line, e.g., double spread sheet. Normally, it is preferable for the container to be made of the integrated material. Namely, by folding an integrated base sheet into half, the double spread condition is generated. Other methods of folding besides the simple mechanical folding method include: a pressed line (recessed groove) on the base sheet; a method of providing a sewing machine line; or a method of engraving a thin wall groove (a so-called half cut) which will be described later. A preferable embodiment of the present invention is that the latter rectangular base sheet body 1 and the rectangular base sheet lid 2 are connected along the folded line through the thin wall groove 3 as shown in FIGS. 1 to 3, where the planar base sheet body 1 and planar base sheet lid 2 are disposed approximately symmetrically with each other.

The material of the rectangular base sheet body 1 and the rectangular base sheet lid 2 of the present invention can be cardboard, coated paper, synthetic paper, and various other laminate sheets, etc. In the practical aspect, the material is not particularly limited, insofar as the instructions such as method of use or remarks on use can be printed or inscribed on the surface.

The rectangular base sheet body 1 is provided by cutting with an open part 10 through which the article can be freely taken out or put in. Accordingly, as shown in FIG. 12 as 10', the open part 10 of the body rectangular base sheet 1 may be partially cut, and depending on the case, such partial cutting may be advantageous in allowing the article to be contained in a stabilized state.

The rectangular base sheet body 1 of the present invention is provided with a transparent cover 4 for accommodating the article. The method for fixing the transparent cover 4 to the rectangular base sheet body 1 is not particularly limited; ordinarily the cover is adhered to the rectangular base sheet body 1 by heat press tightening, pressing, etc., by means of a heat sensitive adhesive, ordinary adhesive, paste, etc. applied thereto in advance.

As the method for fixing this transparent cover 4, there may be considered a method of fixing by adhering to the surface of the rectangular base sheet body 1 as shown in FIG. 7, and a method of adhering to fix to the reverse side of the rectangular base sheet body 1 in a manner to project from the reverse side thereof, as shown in FIG. 8.

The method for producing the container for display and storage as shown in FIG. 7 is practiced, for example, in the following manner.

First, the transparent cover 4 which is formed into a shape that can accommodate the article A is placed facing downward. An article A is place therein, and the rectangular base sheet body 1 to which the other end of the rectangular base sheet lid 2 is adhered in advance by Chinese binding style is placed thereon with its open part 10 directed downward. Then, the base sheet body 1 and the base sheet lid 2 are thermally press-tightened to adhere and to fix the transparent cover 4 which can contain the article A adjacent to the surface of the rectangular base sheet body 1.

The adhesion and combination of the rectangular base sheet body 1 connected to the other end of the rectangular base sheet lid 2 by Chinese binding style with a band style adhesive part 8, and the adhesion and combination of the transparent cover 4 which can accommodate the article A to the rectangular base sheet body 1 may be carried out separately as described above, or may be practiced simultaneously as follows: first, the transparent cover 4 which can accommodate the article A is placed facing downward; article A is accommodated therein; then the rectangular base sheet body 1 having an open part 10 is placed facing downward; the spread sheet of the rectangular base sheet lid 2 is closed; then, the rectangular base sheet body 1 and the other end of the rectangular base sheet lid 2 are heat-pressed together and combined by Chinese style adhesion by means of a band-like adhesive part 8, and at the same time the transparent cover 4 which can accommodate the article A is adhered to combine with rectangular base sheet body 1.

Another method of adhesive fixing is as follows: first, place the rectangular base sheet body 1 having an open part 10 reverse side up; insert the transparent cover 4 which can accommodate the article A into the open part 10 and then place the article therein close the spread sheet of the rectangular base sheet lid 2; then heat-press and tighten the rectangular base sheet body 1 and the other end of the rectangular base sheet lid 2 to combine these sheets by Chinese style adhesion; and adhere the transparent cover 4 which can accommodate the article A to the reverse side of the rectangular base sheet body 1 to combine these two structures.

The adhesion and combination of the rectangular base sheet body 1 with the other end of the rectangular base sheet lid 2 by Chinese style binding with a band style adhesive part 8, and the adhesion and combination of the transparent cover 4 which can secure the article A to the body rectangular base sheet 1 may be carried out either approximately simultaneously or separately.

As described above, the system for adhering to combine the transparent cover 4 to the body rectangular sheet 1 is preferably made by heat press tightening. Ordinarily, a heat sensitive and/or a pressure sensitive adhesive is applied in advance to the surface or reverse side of the rectangular sheet body 1 for top coating. The adhered and combined part of the transparent cover 4 is shown by K in FIG. 3 and FIG. 7.

With respect to the material of the transparent cover 4 to be used in the present invention, preferably transparent resins, e.g., hard vinyl chloride resin, polyester resin, polypropylene resin, and the like are used. The transparent cover 4 is ordinarily prepared in advance by vacuum molding.

In the container for display and storage of the present invention, the rectangular base sheet body 1 and the rectangular base sheet lid 2 are disposed in approximately symmetrical planes relative to each other and are connected in a condition by a folded line through the thin wall groove 3. Accordingly, folding can be easily attained by a method of engraving a thin wall groove 3 (a so-called half cut) at the center of the integral object of the rectangular base sheet body 1. Thus, in the present invention, it is important for the rectangular base sheet body 1 and the rectangular base sheet lid 2 to be connected in a double spread sheet condition.

In the present invention, the rectangular base sheet body 1 and the rectangular base sheet lid 2 are preferably connected in a double spread sheet condition through the thin wall groove while another end is combined by Chinese style binding adhesion. An essential object of the present invention is the Chinese style binding as shown in FIG. 2 and FIG. 3 where the end parts are combined by adhesion in band form, as shown by adhesion part 8. With Chinese style binding, ordinarily, as shown in FIG. 2, a side of the end part (adhesion part 8) is adhered, but in the case of a large base sheet, for example, it is possible that the closed end may become open so that the two spots or three spots may need to be adhered.

An object of the present invention is to allocate a large space for instructions on use of the article and the remarks on use thereof. Accordingly, it is desirable for the adhesion and combination margin to be as small as possible. With the adhesion and combination margin of Chinese style binding being provided at the end part further than the center, the instructions are more easy to read by a user.

In a preferred embodiment, a heat sensitive and/or pressure sensitive adhesive is applied in advance to the surface or reverse side of the rectangular base sheet body 1 or rectangular base sheet lid 2. Adhesion occurs by applying pressure and tightening under heat, in the same manner as in the transparent cover 4 above. It is necessary to apply pressure and tightening under heat so that the adhesion and combination part can be made in as a small area as possible in band form so that the adhesion can be made at a part as near to the end part as possible, according to the above procedure.

The adhesion and combination design is to combine the rectangular base sheet body 1 and the rectangular base sheet lid 2 via Chinese style binding to complete storage of the article A. Besides the adhesion by the above adhesive, pasting, adhesion by viscous agents, line-form sewing, sewing by metal thread, adhesion by adhesives, and especially the case of adhesion by heat, pressure, and tightening are other industrially preferred embodiments of the present invention.

The article is distributed in the condition of being accommodated in the container and placed at the counter. A person who buys and uses the article opens the container. The container for display and storage of the present invention is provided with a unique opening mechanism.

This opening mechanism favorably attains the object of the present invention. Namely, the opening part is preferably provided at the end of the rectangular base sheet lid 2 and in as small a space as possible, in order to make the instructions on use or remarks on use of the article easy to see.

For the above purpose, there is shown in FIG. 1 an example of a cutting out mechanism 7 by a line shape cutting. Besides, another embodiment of the cutting out mechanism 7 includes a two row cutting system (Zipper system) as shown in FIG. 12, or sewing seam system, tape cut system, thread cutting system, and the like. Of the above cutting out systems, the Zipper system is more convenient because the container is opened in a neat linear style without bending which in turn, facilitates storage after opening. According to this Zipper system, an opening mark is provided on the portion shown in the cut-opening part 11 in FIG. 12, or a projection is provided and a recess for cut-opening is provided on the other rectangular base sheet body side as shown by reference number 13, by which the opening is facilitated to give convenience.

The opening mechanism of the present invention is not specifically limited to the above described embodiments, provided that it is securely fixed in the course of distribution or in the situation of the article being placed at the counter. The design of the invention requires that the storage of article can be sufficiently attained, and that the opening can be made with a predetermined force at the time of use.

By opening the rectangular base sheet lid 2 in the double spread sheet embodiment, for example, the double spread sheet condition as shown in FIG. 9 makes it possible to take out the article A contained in the body rectangular base sheet 1.

Consequently, the description part listing the instructions on use of the article or special remarks on use is increased to a size which is double compared to the conventional sheet, and accordingly, it becomes possible to increase instruction contents, and to provide a container for display and storage conforming to PL Laws.

After use of the article, the article is again put in the container part of the rectangular base sheet body 1, and the double spread sheet is closed, and temporarily stopped or fastened as shown in FIG. 10 to recover the container. This temporary stopping or fastening is made by raising the temporary stopping projection 9 formed by cutting into the rectangular base sheet body 1 and inserting the end part of the rectangular base sheet lid 2 therein. As another temporary stopping mechanism, there can be a cutting 12 at the end part as shown in FIG. 11.

Another preferred embodiment of the present invention is, as shown in FIG. 14 to FIG. 20, where the container includes the following: in the vicinity of a center line in the longitudinal direction of the rectangular base sheet body 21 along said center line, a thin wall groove 23 which can be folded outside along the center line is engraved on the rectangular base sheet body 21, a nick line 27 is provided to allow the article A to be freely taken out and put in from the reverse side and a rectangular base sheet lid 21-*c* is formed to act as a lid and a port to take out the article A by the folding of the body rectangular base sheet 21.

The reference numerals in the drawing are as follows:

21 . . . Rectangular base sheet body
21-*a* . . . Cut out part of rectangular base sheet body
21-*b* . . . Rectangular base sheet body
21-*c* . . . Rectangular base sheet lid
23, 23' . . . Thin wall groove (half cut)
24 . . . Transparent cover that contains article
25 . . . Cut in line along the short side direction
26 . . . Hole for suspension
27 . . . Cut in line allowing to take out and contain article freely
29 . . . Temporary stopping mechanism
P . . . Cut opening part
A . . . Article A preferred embodiment of the present invention is, as shown in FIG. 14 to FIG. 20, the mechanism which provides a folding line by engraving a thin wall groove 23. In the rectangular base sheet body formed by utilizing a transparent cover 24 which can contain an article A, along the center line in the longitudinal direction of the rectangular base sheet body 21, a thin wall groove 23 which can be folded outside along the center line is engraved. On the rectangular base sheet body 21, a nick line 27 is provided to allow the article to be freely taken out and put in from the reverse side.

Further, a preferred embodiment of the present invention comprises: at the upper end and/or the lower end part of the rectangular base sheet body 21 and along the short length direction thereof, a separable cut-in line 25 is engraved. Moreover, a preferred embodiment of the present invention comprises: forming, at the end part in the longitudinal direction of the rectangular base sheet body 21, a temporary stopping mechanism 29 which can stop the body rectangular base sheet 21 when it is folded.

Accordingly, a preferred embodiment of the present invention includes a container for display and storage which has a rectangular base sheet body formed by employing a transparent cover which can contain an article; the rectangular base sheet body is provided with a cut-in line engraved along the short-side direction of the end part thereof; and in the vicinity of the center line in the longitudinal direction of the body rectangular base sheet, a thin wall groove which can be folded outside along the center line is engraved. On the rectangular base sheet body, a nick line is provided to allow the article to be freely taken out and put in from the reverse side, and further, at one end part of the rectangular base sheet body, there is provided a temporary stopping mechanism which can stop folding of the body rectangular base sheet.

The present invention includes providing a container for display and storage which has succeeded in solving the problematic points of the prior art by an extremely simple industrial procedure which includes simply providing the conventionally used so-called blister pack with a folding line. The folding line may include engraving a thin wall groove, providing a pressed line (recessed groove), or providing a sewing seam, or the like.

One inventive feature of the present invention is that, by adoption of the folding system of the rectangular base sheet body, an extremely compact container is provided, and when the article is taken out, the container becomes a double spread sheet, so that the description or instructions on use or remarks on the article is easy to read, and remains attached. With such a design, the container is extremely convenient and excellent to use. Hereinafter, the present invention is explained in more detail with reference to the accompanying drawings.

FIG. 14 is a surface view showing the article in a selling display condition where the article is located in the container for display and storage. FIG. 15 is a reverse side view thereof.

Here, the article A, e.g., in the drawing, a container for an instantaneous adhesive (product) is contained in the transparent cover 24 labeled on the body rectangular base sheet 21, and on both surfaces and reverse sides thereof there are instructions, remarks, etc. on how to use the article. The article is placed in article display condition as a so-called instantaneous adhesive contained in a blister.

As shown in FIG. 14, in the rectangular base sheet body 21, for example, at the upper end part thereof, along its short length direction, includes an engraved separable cut-in line 25. In the vicinity of the center line in the longitudinal direction thereof and along the center line, a thin wall groove (a so-called half cut) 23 which can be folded outside along the center line is provided by engraving.

For taking out the article A from the blister, the cut-opening part P provided on the base sheet is pulled up to open the container, and the base sheet can be cut open along the cut lines 27, 27' to the point near the central point S of FIG. 25 (reverse side view), thus allowing removal of the article A with ease. Under this condition, the open port is pulled up or torn by cutting, so that the article A cannot be stored in the container again.

Accordingly, for example, along the separable cut-in line 25, the cutting part 21-*a* of the upper part of the base sheet is cut off. In the vicinity of the center line in the longitudinal direction of the rectangular base sheet body 21, by the thin wall groove 23, normally by a so-called half cut, the base sheet body 21 can be folded outside. Namely, by folding the rectangular base sheet body 21-*b* to the surface and the rectangular base sheet lid 21-*c* to the back side (reverse side), the part of the rectangular base sheet lid 21-*c* functions as the lid to make a container as shown in FIG. 16.

In FIG. 16, the cut-opening part P may be removed by cut-opening at the time of taking out the article A, but in the drawing there is sheet lid 21-*c* of the rectangular base sheet body 21 to form a lid, and by making a temporary stopping with the temporary stopping projection 29, storage of the article A is completed.

FIG. 17 shows the right side view of FIG. 16. In FIG. 17, there is shown a condition where the transparent cover 24 is adhered to combine on the rectangular base sheet body 21 shown in FIG. 14.

FIG. 18 is a surface view showing another example of the container for display and storage of the present invention, and FIG. 19 is a reverse side view thereof.

In FIG. 19, there is shown that, when taking out the article A from the blister pack, the cut-opening part P cut in on the base sheet is pushed to cut open the base sheet to the part of the center S point of FIG. 19 (reverse side view) along the cut-in lines 27, 27', so that the article A can be taken out with ease. Also, as shown in FIG. 19, the cut-in line for allowing to take out and contain the articles freely can be provided by Zipper system.

Further, as shown in FIG. 19, with respect to the temporary stopping mechanism 29, in addition to the cutting in on the semi-circle, the end part may be further cut in to facilitate the insertion for temporary stopping.

FIG. 20 shows a modification of FIG. 18 wherein adjacent to the separable cut-in line 25 as described above, the cutting part 21-*a* on the upper part of the base sheet is cut off. In the vicinity of the center line of the body rectangular base sheet 21 in the longitudinal direction, adjacent the thin wall groove (the so-called half cut) 23, the sheet can be folded outside. By folding the rectangular base sheet body 21-*b* in front, and the rectangular base sheet lid 21-*c* at the back (reverse side), the part of the rectangular base sheet lid 21-*c* functions as the lid to form the container as shown in FIG. 20.

On both the surface and the reverse side of the rectangular base sheet body 21, ordinarily there are printer instructions on how to use the article, or remarks on the use thereof and the like. The container for display and storage of the present invention can be a handy storage case again after use, without discarding these instructions, and thus has the advantages of being extremely simple and compact.

Next, the details of the container for display and storage of the present invention will be further described.

The container for display and storage of the present invention exemplified in FIG. 14 or FIG. 18 is the rectangular base sheet body 21 having the size of 19.5 cm in length X 8.3 cm in width. With this size the container is practically distributed, and is displayed by handing via the suspending hole 26 at the counter.

The container for display and storage of the present invention is completed by providing a cut-in line 25 with which the cutting part 21-*a* on the upper part of the rectangular base sheet body 21 can be separated. The invention is also completed by engraving a thin wall groove 23 that can be folded outside along approximately the center line, in the vicinity of the center line in the longitudinal direction of the rectangular base sheet body 21. Namely, by these steps, the cut-off part 21-*a* at the upper end of the rectangular base sheet body 21 is cut off, and then the rectangular base sheet body 21 is folded outside in a double spread condition, wherein the rectangular base sheet lid 21-*b* becomes the lid to provide the container for display and storage of the present invention.

Separation of the upper end part of the rectangular base sheet body may be disposed at the lower end part, depending on the case.

The material of the rectangular base sheet body 21 of the present invention can be a thick paper, coated paper, synthetic paper, and other various laminates, and the like. There is no particular practical limitation to the material, if the description of use, instructions or remarks on use can be printed and marked on the material.

The rectangular base sheet body 21 of the present invention is provided with a transparent cover 24 for accommodating the articles. The method for fixing this transparent cover 24 to the rectangular base sheet body 21 is not particularly limited, but ordinarily adhesion is made with a heat sensitive adhesive, ordinary adhesive, starch, etc. which is previously applied to the body rectangular base sheet 21 by heat press-tightening, pressing, etc.

With respect to the fixing method of the transparent cover 24, as shown in FIG. 17 (side view), a method of fixing by adhering to the surface of the rectangular base sheet body 21 is the general method. The method for producing the container for display and storage of the present invention can be, for example, as follows:

First, a shaped transparent cover 24 which can contain the article A is placed facing downward, in which the article A is accommodated; then the rectangular base sheet body 21 coated in advance with the heat sensitive adhesive is placed facing downward thereon followed by heat press tightening to adhere the transparent cover 24 that can contain the article A to the surface of the rectangular base sheet body 21.

With respect to the material of the transparent cover 24 to be used for the present invention, the following materials can be used: a transparent resin, e.g., hard vinyl chloride resin, polyester resin, polypropylene resin, etc. The transparent cover 24 is ordinarily made in advance by vacuum molding.

An object of the present invention is to convert the container having a display carrying description of how to use and/or remarks on use of the article (so-called blister) to a compact container for storage by a simple method. With such a design, an extremely simple container for display and storage with the description of how to use and/or remarks on use, etc. can be directly utilized.

In the present invention, the cut-in line along which the article can be freely taken in and out is not specifically limited. Whereas in FIG. 14 and FIG. 19 the line forming the cut-in or the cut out part P by Zipper system is only an example. Other conceivable methods include a two row cutting system (Zipper system), a sewing machine seam system, a tape cut system, and a thread cutting system, etc.

After use of the article, the article is contained again in the original blister pack where the blister pack is stopped temporarily, and the container is utilized. This temporary stopping mechanism is not specifically limitative, but it is preferable to be practiced by one or more temporary stopping projections cut into the end part of the rectangular base sheet body. In FIG. 16 or FIG. 20, a cut-in projection 29 cut into the body rectangular base sheet 21-*b* of the rectangular base sheet body 21 or the cut-in projection 29 cut into the rectangular base sheet body 21 or the cut-in projection 29 cut into the rectangular base sheet lid 21-*c* is raised, to which the other rectangular base sheet lid 21-*c* or the end of the rectangular base sheet body 21-*b* is inserted to complete the so-called temporary stopping.

Possibility of industrial utilization

The container for display and storage according to the present invention is extremely convenient for storage and keeping of the articles such as a container of instantaneous adhesives. Since an instantaneous adhesive or the like is repeatedly used, there is required a container for storage when it is used once, stored, later used again. And, the storage case provides detailed description of how to use remarks on how to use the article. The container for display and storage of the present invention is particularly suited for such a purpose.

In the container for display and storage of the present invention, one special benefit is that, because the container for storage after the article is taken out becomes a double spread sheet, the area reserved for listing the instruction on use or remarks on use is increased to about double that of an ordinary case container, so that notwithstanding the slim blister pack description can be listed in a large volume while simultaneously meeting the PL Law enforcement.

In addition to the simple effect as a blister pack, the present invention can be utilized for storage and keeping, and after the article is taken out by breaking the blister pack, the pack is not thrown away into the trash. With such a design the problem of missing instructions is resolved.

As it is possible for the display and storage container of the present invention to be manufactured in a slim style, it does not occupy much space in the selling store, and it can be easily viewed, so that it can resolve the problems of the conventional art.

The container for display and storage of the present invention is extremely advantageous since it is easily produced industrially without necessitating large modification to the conventional process for making blister packs.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A display and storage container for an article comprising:

a planar sheet of material having a fold, said fold separating said planar sheet into a base sheet body and a base sheet lid, said base sheet lid and said base sheet body each having a longitudinal edge, said base sheet body having an aperture with a predefined shape substantially matching a perimeter of the article;

printed matter being disposed on said base sheet body and said base sheet lid;

a Chinese style binding adhesive connecting respective longitudinal edges when said planar sheet is in a folded condition;

a temporary stopping mechanism being disposed on said base sheet body, said stopping mechanism securing said base sheet body to said base sheet lid after initial opening of the container;

an opening mechanism being disposed on an end part of said base sheet body; and a transparent cover being disposed on the base sheet body, said planar sheet and said cover substantially enclose the article when said sheet is in a folded condition while said planar sheet substantially increases supporting surface area for said printed matter when said planar sheet is in an unfolded condition.

2. The display and storage container of claim 1, wherein said base sheet body and said base sheet lid are substantially rectangular.

3. The display and storage container of claim 1, wherein said fold includes a thin walled groove.

4. The display and storage container of claim 1, wherein said base sheet body and said base sheet lid are symmetrical with respect to each other.

5. The display and storage container of claim 1, further comprising an adhesive between said transparent cover and said b as e sheet body.

6. The display and storage container of claim 1, wherein said a Chinese style binding adhesive includes a band form.

7. The display and storage container of claim 1, wherein said opening mechanism includes line-form cutting.

8. The display and storage container of claim 7, wherein said line-form cutting includes a zipper system.

9. The display and storage container of claim 1, wherein said stopping mechanism includes two projections formed by cutting said base sheet body.

10. A method of manufacturing a display and storage container for an article comprising the steps of:

placing a transparent cover facing downward;

placing the article within the cover;

providing a fold on a planar sheet of material which separates the sheet into a base sheet body and a base sheet lid, the base sheet body and the base sheet lid each having a longitudinal edge;

providing printed matter on the base sheet body and the base sheet lid;

forming an aperture in the base sheet body with a predefined shape substantially matching a perimeter of the article;

providing a temporary stopping mechanism on the base sheet body;

providing an opening mechanism on an end part of the base sheet body;

providing a Chinese style binding adhesive on each longitudinal edge;

heating and pressing the transparent cover against the base sheet body to adhere the cover to the base sheet body;

folding the planar sheet of material; and sealing each longitudinal edge to a respective longitudinal edge, the planar sheet and the cover substantially enclose the article when the sheet is in a folded condition while the planar sheet substantially increases area for the printed matter when the planar sheet is in an unfolded condition.

11. A method of manufacturing a display and storage container for an article comprising the steps of:

placing a transparent cover facing downward;

placing the article within the cover;

providing a fold on a planar sheet of material which separates the sheet into a base sheet body and a base sheet lid, the base sheet body and the base sheet lid each having a longitudinal edge;

providing printed matter on the base sheet body and the base sheet lid;

forming an aperture in the base sheet body with a predefined shape substantially matching a perimeter of the article;

providing a temporary stopping mechanism on the base sheet body;

providing an opening mechanism on an end part of the base sheet body;

providing a Chinese style binding adhesive on each longitudinal edge;

heating and pressing the transparent cover against the base sheet body to adhere the cover to the base sheet body;

folding the planar sheet of material so that the cover is projects through the aperture and while a perimeter of the cover is disposed between the base sheet body and the base sheet lid; and sealing each longitudinal edge to a respective longitudinal edge, the planar sheet and the cover substantially enclose the article when the sheet is in a folded condition while the planar sheet substantially increases area for the printed matter when the planar sheet is in an unfolded condition.

12. A display and storage container for an article comprising:

a substantially rectangular planar sheet of material having a fold, said fold separating said planar sheet into a base sheet body and a base sheet lid, said planar sheet having a first side and a second side;

printed matter being disposed on said base sheet body and said base sheet lid, said base sheet body and said base sheet lid having substantially equal perimeters, said base sheet lid having a first surface area for supporting said printed matter, said base sheet body having a second surface area for supporting said printed matter, said base sheet body having an aperture with a predefined shape substantially matching a perimeter of the article, said first surface area being greater than said second surface area;

a first heat-press adhesive band being disposed along a first longitudinal edge of said base sheet lid on said second side;

a second heat-press adhesive band being disposed along a second longitudinal edge of said base sheet body on said second side, said first heat-press adhesive band mating with said second heat-press adhesive band when said sheet is in a folded condition, said first and said second longitudinal edges being substantially parallel and opposite to said fold;

zipper cutting means for separating said first heat-press adhesive band and said second heat-press adhesive band from said sheet being disposed on said base sheet lid adjacent to said second longitudinal lid, said zipper cutting means substantially reducing tears and bending of said base sheet lid while facilitating smooth opening of the container when said sheet is in a folded condition;

a substantially C-shaped stopping mechanism being disposed on said base sheet body, said stopping mechanism being formed by a substantially C-shaped aperture disposed in said base sheet body, said stopping mechanism securing said base sheet body to said base sheet lid after initial opening of the container; and a transparent cover being disposed over said aperture of the base sheet body, said transparent cover being attached to said base sheet body by an adhesive, said cover having a shape substantially corresponding to the perimeter of the article and said aperture, said planar sheet and said cover substantially enclose the article when said sheet is in a folded condition while said base sheet body and base sheet lid substantially increase supporting surface area for said printed matter when said planar sheet is in an unfolded condition.

13. The display and storage container of claim 12, wherein said fold includes a thin walled groove.

14. The display and storage container of claim 13, wherein said base sheet body and said base sheet lid are substantially rectangular.

15. The display and storage container of claim 14, wherein said printed matter is disposed on said first and said second sides of said planar sheet.

16. The display and storage container of claim 15, wherein said aperture includes a cut-line engraved in said base sheet body.

17. The display and storage container of claim 16, wherein said stopping mechanism is a first stopping mechanism, said base sheet body further including a second stopping mechanism, said second stopping mechanism being formed by a cut region in a corner of said base sheet body.

18. The display and storage container of claim 17, wherein said sheet is made of one of card board, coated paper, and synthetic paper; said transparent cover is made of one of vinyl chloride resin, polyester resin, and polypropylene.

19. A method of manufacturing a display and storage container for an article comprising the steps of:

providing a transparent cover, said cover having a shape substantially corresponding to the article and said aperture;

placing the article within the cover;

providing a fold line on a substantially rectangular planar sheet of material, said fold line dividing said planar sheet into a base sheet body and a base sheet lid, the base sheet body and the base sheet lid each having a longitudinal edge and substantially equal perimeters, said base sheet lid having a first surface area, said base sheet body having a second surface area, said first surface area being greater than said second surface area;

forming an aperture in the base sheet body with a predefined shape substantially matching a perimeter of the article;

forming a substantially C-shaped stopping aperture in said base sheet body;

providing a zipper cutting mechanism on said base sheet lid adjacent to said second longitudinal lid, said zipper cutting mechanism substantially reducing tears and bending of said base sheet lid while facilitating smooth opening of the container when said sheet is in a folded condition;

printing matter on the base sheet body and the base sheet lid;

adhering the cover to said base sheet body over said aperture said transparent cover being attached to said base sheet body by an adhesive, said cover having a shape substantially corresponding to the article and said aperture;

providing a first heat-press adhesive band along a first longitudinal edge of said base sheet lid on said second side;

providing a second heat-press adhesive band along a second longitudinal edge of said base sheet body on said second side;

mating said first heat-press adhesive band with said second heat-press adhesive band after folding said sheet, said first and said second longitudinal edges being substantially parallel and opposite to said fold;

separating said first heat-press adhesive and said second heat-press adhesive from said sheet with said zipper cutting mechanism; and securing said base sheet body to said base sheet lid with said stopping aperture after opening the container, said planar sheet and said cover substantially enclose the article when said sheet is in a folded condition while said base sheet body and base sheet lid substantially increase supporting surface area for said printed matter when said planar sheet is in an unfolded condition.

20. The method of claim 19, wherein the step of providing a fold line includes providing a thin walled groove.

21. The method of claim 20, wherein the step of printing matter includes printing matter on a first and a second side of said planar sheet.

22. The method of claim 21, wherein the step of forming an aperture includes providing a cut-line engraved in said base sheet body.

23. The method of claim 22, wherein said stopping aperture is a first stopping aperture, the method further including forming a second substantially C-shaped stopping aperture, said second stopping aperture being formed by a cut region in a corner of said base sheet body.

24. The method of claim 23, further comprising the step of forming said sheet from one of card board, coated paper, and synthetic paper, and forming said transparent cover from one of vinyl chloride resin, polyester resin, and polypropylene.

25. A case for storage and exhibition comprising:

a main-body including a rectangular base made of paper, said main-body further including a rectangular cover made of paper, said base and said rectangular cover each including a first planar side and a second planar side, said rectangular base being substantially symmetrical with said rectangular cover, said rectangular base being connected to said rectangular cover by a fold;

instructional printed matter addressing an article being disposed on each first planar side and each second planar side of said rectangular base and said rectangular cover;

an adhesive affixing edges of said rectangular base and said rectangular cover together, when said rectangular base and said rectangular cover being in a closed condition;

a transparent cover disposed on said rectangular base to store an article;

an opening mechanism being disposed on an edge of said rectangular cover; and a temporary stopping mechanism for clamping the rectangular base to the rectangular cover after said adhesive has been broken by a user, whereby the article stored in said transparent cover is removable from said rectangular base and said transparent cover during an open condition while said instructional printed matter has increased supporting surface area which includes said rectangular cover and said rectangular base.

* * * * *